United States Patent [19]

Delzio

[11] Patent Number: 4,927,147

[45] Date of Patent: May 22, 1990

[54] CHARADE AND DRAWING CARD GAME USING DICE

[76] Inventor: Robert J. Delzio, P.O. Box 20251, San Deigo, Calif. 92120

[21] Appl. No.: 180,146

[22] Filed: Apr. 11, 1988

[51] Int. Cl.[5] ..... A63F 1/04; A63F 9/04

[52] U.S. Cl. ..... 273/146; 273/304

[58] Field of Search ..... 273/146, 304, 292

[56] References Cited

U.S. PATENT DOCUMENTS 4,219,197 8/1980 Acuff ..... 273/304 X 4,735,419 4/1988 Koca ..... 273/146 X

*Primary Examiner*—Anton O. Oechsle

[57] ABSTRACT

A charade and drawing card game using dice to reference specific words or phrases to be charaded or drawn by players. Eighteen different words or phrases categorized into three letter groups of six words or phrases each comprise the inner rectangular surface area of each card face. The outer perimeter of each card face displays the markings of a standard poker playing card deck thereby allowing independent play of poker-related games entirely unrelated to the disclosed card game of charades and drawing. The three distinct dice of the disclosed card game when tossed simultaneously serve to direct players to a particular word or phrase and to direct players as to whether that word or phrase is to be charaded or drawn. Points are awarded for correctly guessing the word or phrase play. The poker deck markings feature is unrelated to the play and originality of the disclosed charade and drawing card game.

2 Claims, 1 Drawing Sheet

CHARADE AND DRAWING CARD GAME USING DICE

BACKGROUND AND SUMMARY

The game of charades has been in existence for many years. It is a game in which words or phrases are acted out amongst players with the object being to correctly guess the word or phrase in play. In recent years, a variation on the charades theme has become popular. That variation calls for the actual drawing or sketching of the meaning of the word or phrase instead of charading. Examples of such drawing games are "PICTIONARY" and "WIN, LOSE, OR DRAW".

To date, no game has existed as the herein disclosed game invention which incorporates the themes of both charades and drawing in one game. The essence of the disclosed game is a supply of cards upon which are imprinted categorized words or phrases no two alike. The toss of three specially designed dice, simultaneously, refers players to a specific word or phrase and indicates to player whether that word or phrase is to be charaded or drawn.

It should be noted that the disclosed game patent application depicts the imprinted words and phrases upon the inner rectangular area of a standard deck of poker playing cards (see FIGS. 1 and 2 of drawings). The poker deck feature is entirely independent and unrelated to the playing of the disclosed game. The poker deck feature has been adopted merely for the purpose of enhancing game marketability by offering two separate card games in one deck.

A detailed description of the game including the design and use of the three game dice is presented in the following drawings and preferred embodiment sections of this patent application.

DESCRIPTION OF THE PREFERRED EMBODIMENT

Figure 1:
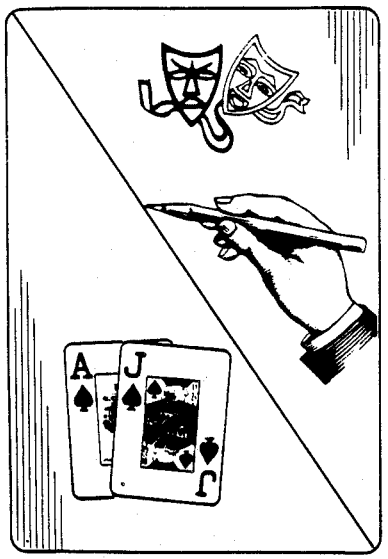
FIG. 1 of the drawings depicts the proposed design of the back or cover surface of the disclosed game playing cards.
Figure 2:
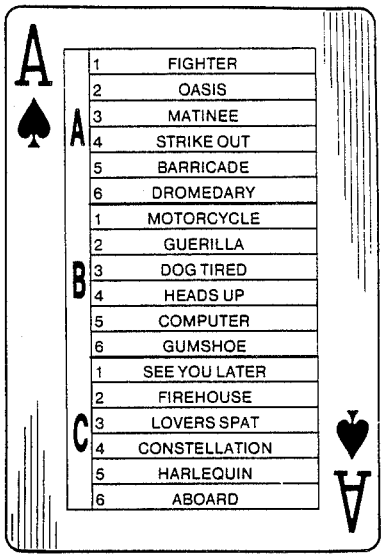
FIG. 2 shows the face surface of the game cards. Note that incorporation of the poker deck feature along the outer perimeter of the card face. The inner rectangular area of the card face lists the eighteen words and phrases per card categorized into three letter groups of six words or phrases each.
Figure 3:
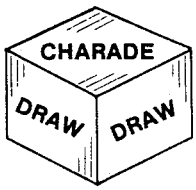
FIG. 3 depicts the Charade/Draw Die. Three sides read Charades, and three sides read Draw.
Figure 4:
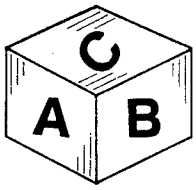
FIG. 4 depicts the Letter Die. Two sides read "A", two sides "B", and two sides "C".
Figure 5:
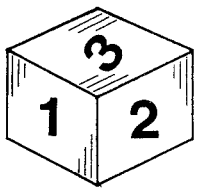
FIG. 5 depicts the Number Die. The six sides are numbered 1 through 6.

The game consists of a deck of playing cards and three dice (see FIGS. 1 through 5 of drawings). The number of cards is fifty-two in the case of this disclosed invention. The proposed playing card size is that of a standard poker playing card. The back side of every card will display the identification logo or trademark or some other specific pattern.

The face of each card (see FIG. 2) is described as an outer perimeter area which displays the common symbols and markings of a standard poker playing card deck, and the inner rectangular area which displays the unique words and phrases categorized for play of the disclosed game. It is this concept of printing the categorized words and phrases upon a standard poker playing deck that allows the play of two separate and distinct card games.

However, let us focus attention to the inner rectangular area of each card face. It is this configuration that is the essence of the disclosed game invention.

The invention rectangular area of each face card (FIG. 2) lists eighteen different words or phrases categorized into three groups of six words or phrases each. The three groups of words or phrases are marked "A", "B", and "C". The six words or phrases in each letter group are numbered "1" through "6".

The eighteen words or phrases per face card ae so categorized by letter and number to allow referencing to a specific word or phrase with the toss of the three game dice (FIGS. 3, 4, 5) simultaneously. Note the three distinct six-sided dice of the disclosed game. The Letter Die (FIG. 4), marked two sides "A", two sides "B", two sides "C", directs players to one of the three letter categories on the playing card, "A", "B", and "C".

The Number Die (FIG. 5), marked "1" through "6", determines the specific word or phrase within the letter category.

The Charade/Draw Die, marked three sides "Charades" and three sides "Draw", is an item of originality in this game and it directs players to either charade the word or phrase in play or instead to draw the particular word or phrase in play.

The game allows two or more players per team. Alternating with each turn, one team member will draw or enact charade while another member of the team will "receive" or attempt to correctly guess the word or phrase in play.

Prior to start of game, a roll of the Number Die by each team determines the order of play (highest number designates first turn).

Cards are shuffled, placed face down, and top card is picked up by team member responsible for drawing or enacting charade.

All three dice are tossed, simultaneously, by team in play to establish:

(1) whether the drawing or charade is required (Charade/Draw Die)
(2) the letter category, A, B, or C (Letter Die)
(3) the actual word or phrase to be played (Number Die)
(4) the point value assigned to a correct guess (Number Die)

A time glass sets a one-minute limit during which time the "receiving" member of team attempts to correctly guess the meaning of the drawing or charade.

A correct guess earns assigned points and an extra turn. The passing of one minute without a correct guess will move play to next team in order.

Played cards are returned to bottom of deck. The first team to reach an agreed upon point total wins the game.

I claim:

1. A charade and drawing card game consisting of a supply of cards each bearing eighteen words or phrases categorized into three letter groups, A, B, and C, of six words or phrases each, numbered 1 through 6, utilizing three distinct six-sided dice, the Letter Die (two sides "A", two sides "B", two sides "C"), the Number Die (numbered 1 through 6), and the Charade/Draw Die (three sides "Charade", three sides "Draw"), which when tossed simultaneously, these dice serve to reference specific words or phrases and denote the drawing or charading of that word or phrase.

2. The charade and drawing card game of claim 1, wherein said Charade/Draw Die enables the dual function of charades or drawing with each turn of play in this game.

* * * * *